US007575182B2

(12) United States Patent
Rogers, II

(10) Patent No.: US 7,575,182 B2
(45) Date of Patent: Aug. 18, 2009

(54) NOZZLE STRUCTURE

(75) Inventor: Michael C. Rogers, II, Mt. Sterling, KY (US)

(73) Assignee: R.P. Scherer Technologies, Inc., Las Vegas, NV (US)

( * ) Notice: Subject to any disclaimer, the term of this patent is extended or adjusted under 35 U.S.C. 154(b) by 354 days.

(21) Appl. No.: 11/437,012

(22) Filed: May 18, 2006

(65) Prior Publication Data

US 2007/0266591 A1 Nov. 22, 2007

(51) Int. Cl.

| | |
|---|---|
| ***B05B 7/06*** | (2006.01) |
| ***B05B 7/10*** | (2006.01) |
| ***B05B 1/28*** | (2006.01) |
| ***B05B 1/00*** | (2006.01) |

(52) U.S. Cl. ..... 239/424; 239/290; 239/403; 239/405; 239/406; 239/418; 239/423; 239/600

(58) Field of Classification Search ..... 239/600, 239/398, 418, 423, 424, 421, 290, 399, 403, 239/405, 406, 433, 434.5, 416, 294, 296, 239/300, 402, 420, 463, 465, 474, 490, 491
See application file for complete search history.

(56) References Cited

U.S. PATENT DOCUMENTS

| | | | | | |
|---|---|---|---|---|---|
| 1,051,672 | A * | 1/1913 | Boudreaux | 239/416.3 |
| 3,529,126 | A * | 9/1970 | Reeh Olaf | 219/137.62 |
| 3,556,408 | A * | 1/1971 | De Voe | 239/403 |
| 3,720,496 | A * | 3/1973 | Briggs | 431/353 |
| 3,779,460 | A * | 12/1973 | Monro | 239/426 |
| 3,908,903 | A * | 9/1975 | Burns, Jr. | 239/2.2 |
| 4,109,131 | A * | 8/1978 | Schluter | 219/137.62 |
| 4,171,091 | A * | 10/1979 | van Hardeveld et al. | 239/8 |
| 4,263,346 | A * | 4/1981 | Sandell | 427/196 |
| 4,265,235 | A * | 5/1981 | Fukunaga | 128/200.24 |
| 4,526,322 | A * | 7/1985 | Voorheis | 239/404 |
| 4,863,105 | A * | 9/1989 | Bennett | 239/397.5 |
| 4,877,396 | A * | 10/1989 | Wunning | 431/158 |
| 4,960,244 | A * | 10/1990 | Maag et al. | 239/424 |
| 5,054,689 | A * | 10/1991 | Hunerberg et al. | 239/412 |
| 5,114,075 | A * | 5/1992 | Verduyn | 239/135 |
| 5,135,703 | A * | 8/1992 | Hunerberg et al. | 264/572 |
| 5,332,161 | A * | 7/1994 | Schweitzer et al. | 239/600 |
| 5,726,414 | A * | 3/1998 | Kitahashi et al. | 219/121.48 |
| 5,791,562 | A * | 8/1998 | Kramer et al. | 239/399 |
| 5,810,252 | A * | 9/1998 | Pennamen et al. | 239/8 |
| 5,829,683 | A * | 11/1998 | Beaudoin et al. | 239/429 |
| 6,047,926 | A * | 4/2000 | Stanko et al. | 244/134 R |
| 6,293,498 | B1 * | 9/2001 | Stanko et al. | 244/134 R |

* cited by examiner

*Primary Examiner*—Darren W Gorman
(74) *Attorney, Agent, or Firm*—Fitzpatrick, Cella, Harper & Scinto

(57) ABSTRACT

A nozzle device is disclosed that may be used with a fluid-bed dryer apparatus or system. Such a nozzle device includes, in one embodiment, an intake block, an inner tube, an outer tube, a tip and an air cap. The tubes are connected to the intake block to form a passage for liquid and a passage for gas. The tip connects to the inner tube, and the air cap connects to the outer tube, so that at the output the fluid is atomized by the gas. Flow of the liquid and gas through the nozzle is unimpeded, and the nozzle provides substantially constant atomization characteristics.

17 Claims, 4 Drawing Sheets

NOZZLE STRUCTURE

The present disclosure relates to apparatus for spraying fluid into a fluid-bed dryer machine. In particular, this disclosure relates to improved nozzle structure that can be used in manufacturing pharmaceutical preparations.

In the preparation of certain pharmaceuticals, apparatus known as a fluid-bed dryer can be used. One such type of pharmaceutical begins with small particles of a sugar (e.g. sucrose) that are approximately spherical and of a size range approximately the same as table salt. The particles are placed in a drum or receptacle of a fluid-bed dryer apparatus. Via air circulation, rotation, or other methods, the particles are moved around in the apparatus, and in some apparatus the particles can be suspended in a relatively stable air flow. A fluid pharmaceutical preparation is sprayed into the apparatus. Droplets of the pharmaceutical coat the sugar particles, preferably to a substantially uniform thickness or to some other substantially uniform degree, and the pharmaceutical preparation dries or cures on the particles. In this way, an amount of particles is manufactured each of which includes an approximate amount of the pharmaceutical preparation. A portion of the particles can then be further processed into a dose for human or animal consumption, as by inserting the portion into a gelatin capsule or pressing the particles into a tablet.

The pharmaceutical fluid is sprayed into the fluid-bed dryer via one or more nozzles. Prior nozzle structures for fluid-bed dryer systems have suffered from a number of drawbacks. As one example, prior nozzles have been quite complicated structures having internal adjustment features for variation of atomization characteristics and air consumption during use. One such nozzle includes an internal needle that is spring-biased in order to provide such variability. The complex nature of such nozzles produces several disadvantages, particularly where adjustability or changeability of atomization characteristics and/or air consumption is not needed or desired. Among those disadvantages are the large number of parts that must be cleaned and checked after each use. Further, there are more places in such nozzles where sticking or other malfunction of the nozzle can occur, and there is quite a high cost to replace or fix such nozzles when they break down. Such prior nozzles may also be manufactured to particular and relatively peculiar specifications, leading to incompatibility with spare parts not made by the original manufacturer and difficulty in disassembling them.

DESCRIPTION OF THE ILLUSTRATED EMBODIMENT

Figure 1:
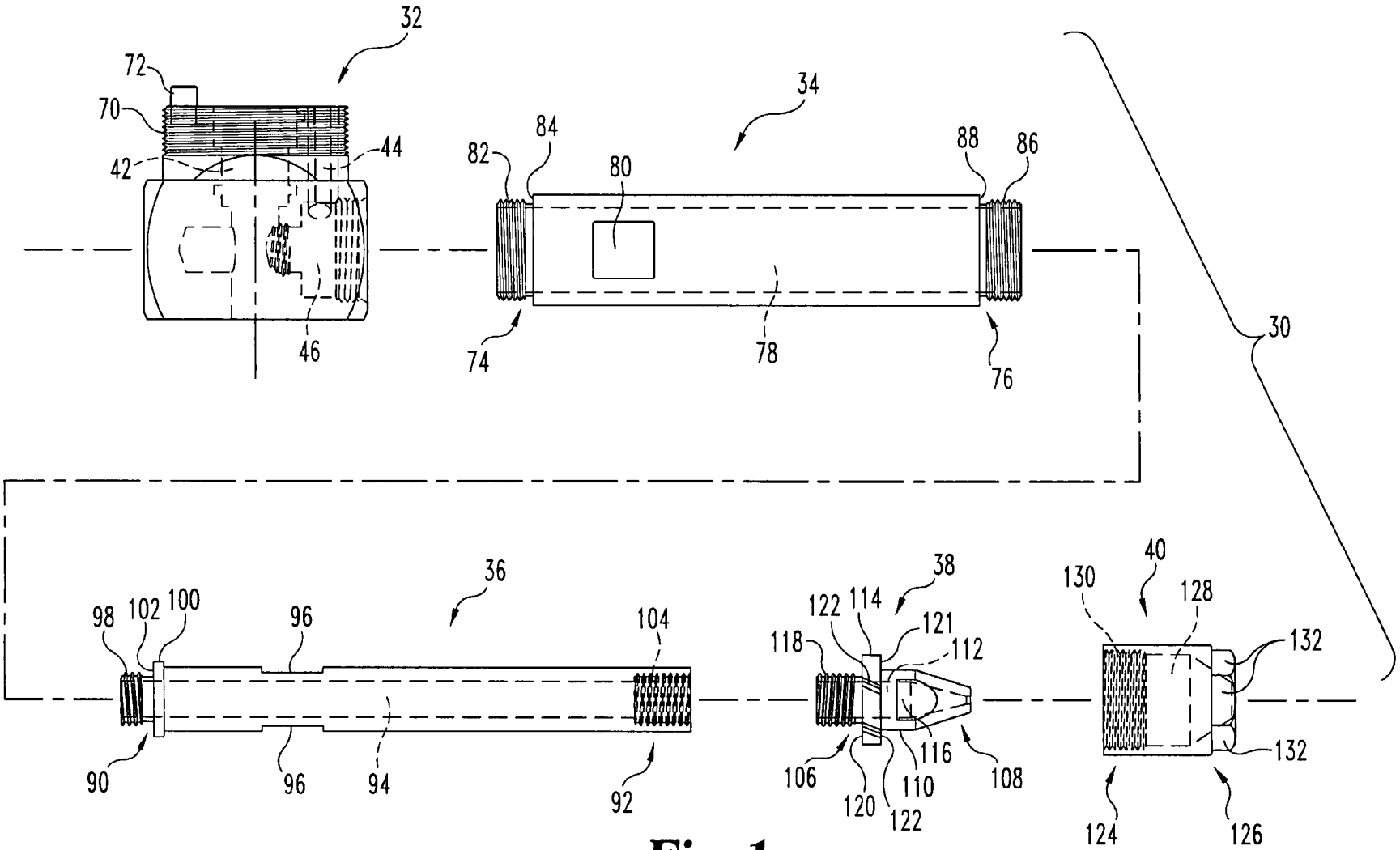
FIG. 1 is an exploded view of one embodiment of a nozzle as further disclosed herein.

For the purposes of promoting an understanding of the principles of the disclosure, reference will now be made to the embodiments illustrated in the drawings and specific language will be used to describe the same. It will nevertheless be understood that no limitation of the scope of the claims is thereby intended, such alterations and further modifications in the illustrated devices, and such further applications of the principles of the disclosure as illustrated therein, being contemplated as would normally occur to one skilled in the art to which the disclosure relates.

Referring generally to the figures, there are shown embodiments of a nozzle device 30 that can be used in connection with a fluid-bed dryer apparatus or system. In the illustrated embodiment, nozzle 30 includes an intake block or manifold 32, an external tube 34, an internal tube 36, a tip 38 and an air cap 40. Nozzle 30 connects to a source of liquid and to a source of gas, so that the liquid and gas are substantially unimpeded through nozzle 30 and generate an atomized spray of the liquid from tip 38 and air cap 40. In particular embodiments, the liquid can be a liquid pharmaceutical preparation, and the gas can be air. As used herein, "pharmaceutical preparation" means a chemical that has at least a part with therapeutic properties, and may include additional solvents or other non-active ingredients.

Intake block 32, in the illustrated embodiment, includes a liquid intake opening 42, a gas intake opening 44, and an output opening 46. Liquid intake opening 42 is configured to be joined to a source of liquid (not shown), which may include a tube or other conduit that is inserted into or around opening 42. The illustrated embodiment of opening 42 has three general regions, an outer region 48 that is of a relatively large diameter, a middle region 50 somewhat smaller in diameter than outer region 48, and an inner region 52 that is somewhat smaller in diameter than middle region 50. Opening 42 may further include one or more grooves 54 for O-rings or other sealing members, and in the illustrated embodiment one groove 54 is found in outer region 48 relatively near to an outer surface of block 32 and one is found in middle region 50 relatively near to inner region 52. Consequently, opening 42 can accommodate a tube or conduit of a variety of sizes and/or flexibilities. A tube having an outer diameter approximately the same as the inner diameter of middle region 50 can be inserted through outer region 48 and into middle region 50, and against a surface 56 adjacent inner region 52. Larger tubes may be inserted into outer region 48 and against a surface 58 adjacent middle region 50. O-rings or other sealing members (not shown), if used, may be chosen so as to firmly engage both a fluid inlet tube and groove(s) 54 of block 32.

Although each portion of opening 42 is depicted as substantially cylindrical, it will be seen that the cross-sectional shape of any portion of opening 42 could be otherwise.

Figure 2:
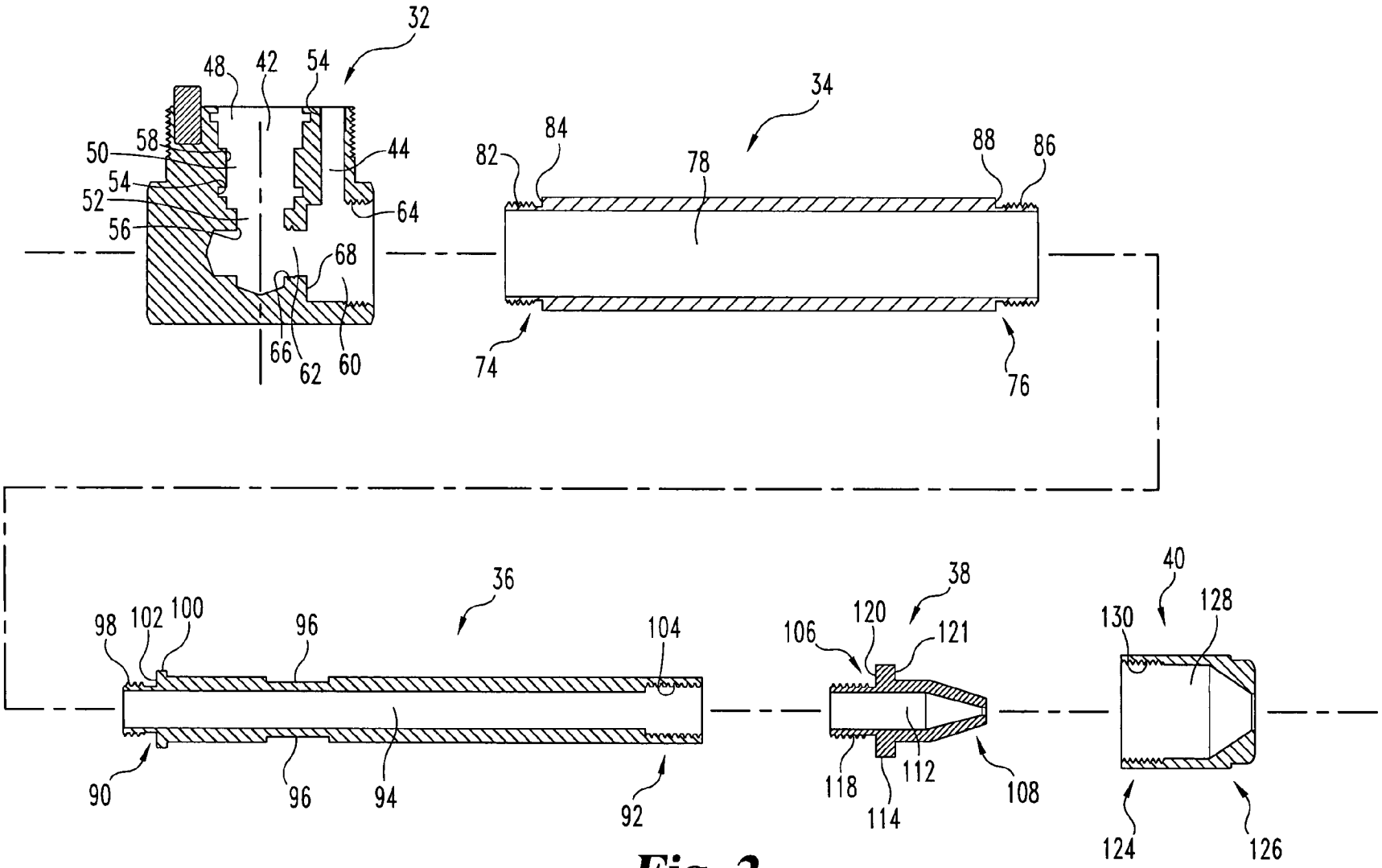
FIG. 2 is an exploded view of cross-sections, taken medially in the plane of the page of FIG. 1, of the embodiments of the parts of the nozzle embodiment shown in FIG. 1.
Figures 3, 4, 5, 6, 7, 8, 9, 10, 11:
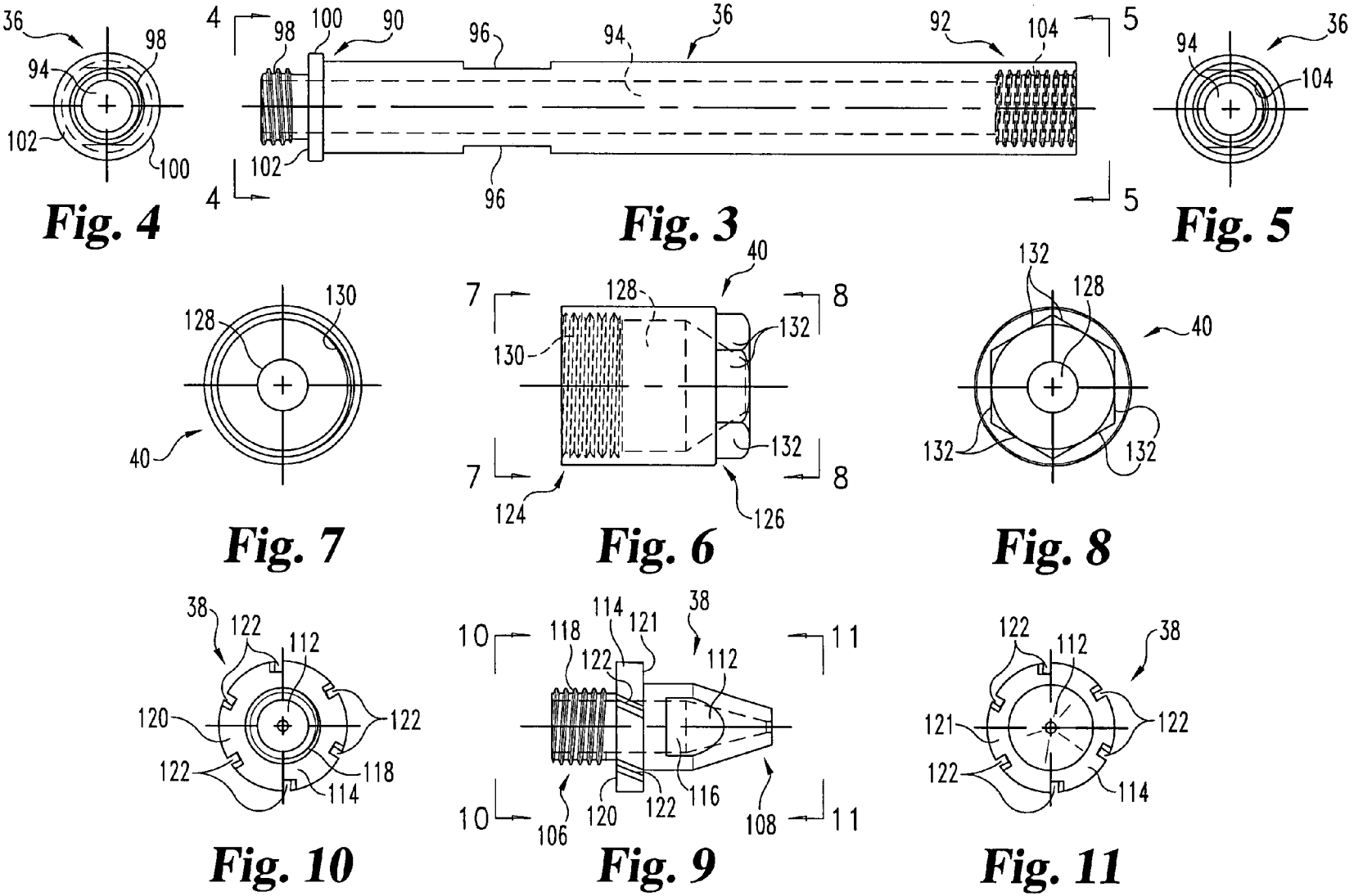
FIG. 3 is a side elevational view of an embodiment of a part of the nozzle embodiment shown in FIG. 1.
FIG. 4 is an end view, taken from the line 4-4 in FIG. 3 and viewed in the direction of the arrows, of the embodiment shown in FIG. 3.
FIG. 5 is an end view, taken from the line 5-5 in FIG. 3 and viewed in the direction of the arrows, of the embodiment shown in FIG. 3.
FIG. 6 is a side elevational view of an embodiment of another part of the nozzle embodiment shown in FIG. 1.
FIG. 7 is an end view, taken from the line 7-7 in FIG. 6 and viewed in the direction of the arrows, of the embodiment shown in FIG. 6.
FIG. 8 is an end view, taken from the line 8-8 in FIG. 6 and viewed in the direction of the arrows, of the embodiment shown in FIG. 6.
FIG. 9 is a side elevational view of an embodiment of another part of the nozzle embodiment shown in FIG. 1.
FIG. 10 is an end view, taken from the line 10-10 in FIG. 9 and viewed in the direction of the arrows, of the embodiment shown in FIG. 9.
FIG. 11 is an end view, taken from the line 11-11 in FIG. 9 and viewed in the direction of the arrows, of the embodiment shown in FIG. 9.
Figure 12:
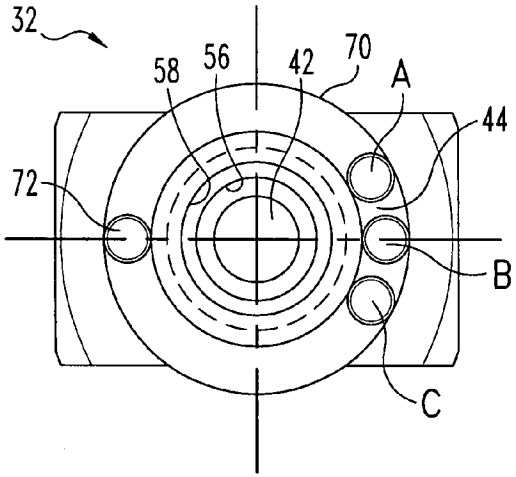
FIG. 12 is a top plan view of an embodiment of a part of the nozzle embodiment shown in FIG. 1.
Figure 13:
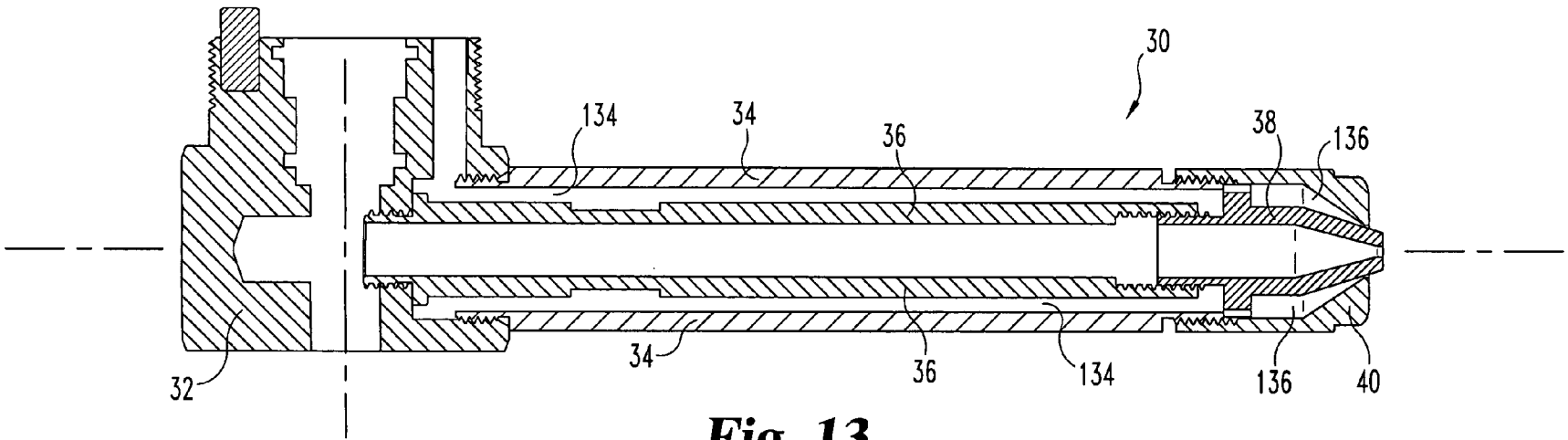
FIG. 13 is a cross-sectional view as in FIG. 2, with parts of the nozzle embodiment assembled.

Gas intake opening 44 is substantially parallel to and offset from liquid intake opening 42 in the illustrated embodiment. As seen in the figures, opening 44 is offset relatively forward of opening 42, i.e. toward tubes 34 and 36. Opening 44 is configured to be joined to a source of gas (not shown), which may include a tube or other conduit that is inserted into or around opening 44. Opening 44 is substantially smaller in diameter than any portion of opening 42, and in a particular embodiment (e.g. FIG. 2) opening 44 may have a diameter that is approximately half of the diameter of inner region 52 of opening 42. Although opening 44 is depicted as substantially cylindrical, it will be seen that the cross-sectional shape of opening 44 could be otherwise. The illustrated embodiment of gas intake opening 44 includes three separate tubes (A, B, C) adjacent each other. In other embodiments, fewer or additional tubes may be provided.

Output opening 46 is directed substantially perpendicularly to openings 42 and 44 in the illustrated embodiment, but it may be otherwise oriented in other embodiments. Opening 46 has an outer portion 60 and an inner portion 62, each of which is at least partially threaded in the illustrated embodiment. Outer portion 60 is of a diameter approximately the same as or larger than the diameter of outer region 38 of opening 42, and outer portion 60 connects to opening 44. In a particular embodiment, internal thread 64 extends from an outer surface of block 32 approximately to the point where opening 44 connects to outer portion 60 of opening 46. Inner portion 62 of opening 46 is of a diameter approximately the same as or larger than inner portion 52 of opening 42, and inner portion 62 connects to opening 42. Internal thread 66 extends from the point where inner portion 62 and opening 42 along about half of the length of inner portion 62 toward a seating surface 68. Threads 64 and 66 are standard machine threads in this embodiment.

The portion of block 32 through which openings 42 and 44 extend is substantially cylindrical in the illustrated embodiment and includes an external thread 70 and a boss 72. This portion enables easy connection of a single conduit (not shown) that has compatible liquid and gas transfer tubes, an aperture for proper placement, and an internally-threaded collar. Such a conduit can be fitted to block 32 by placing its aperture over boss 72, which placement ensures proper connection between the conduit's liquid and gas tubes and openings 42 and 44 of block 32, respectively. Threading a collar of the conduit onto thread 70 of block 32 ensures secure connection of the conduit to block 32.

External tube 34 is substantially cylindrical in the illustrated embodiment, and has a first externally threaded end 74, a second externally threaded end 76, a lumen 78 with a substantially constant diameter, and one or more external flats 80. End 74 includes a standard machine thread 82, which in a particular embodiment has a crest diameter that is less than the outer diameter of tube 34. A ledge or flange 84 is adjacent thread 82. End 76 is substantially the same as end 74, having a machine thread 86 and a ledge 88. In the illustrated embodiment, end 76 is slightly longer than end 74, but in other embodiments end 76 may be substantially the same length as or shorter than end 74. When assembled to block 32, thread 82 of end 74 is screwed into thread 64 of outer portion 60 of opening 44, and ledge 84 seats on or mates with an outer surface of block 32. In this way, a sealed passage is formed from outer portion 60 of opening 44 and lumen 78 of tube 34. In the illustrated embodiment, two substantially square flats 80 are provided which are diametrically opposed to each other on the outer surface of tube 34. Flats 80 are sized and configured to accommodate standard tools, such as wrenches, so that tube 34 can be easily removed from and connected to block 32 without substantial marring or other damage to the exterior surface or other parts of tube 34.

The illustrated embodiment of internal tube 36 is also substantially cylindrical, having a first externally threaded end portion 90, a second internally threaded end portion 92, a lumen 94 of substantially constant diameter, and one or more external flats 96. End 90 includes a standard machine thread 98 along at least part of its length, which in a particular embodiment has a crest diameter that is less than the outer diameter of tube 36. A flange 100 is adjacent thread 98 in this embodiment, and has an outer diameter at least slightly greater than the outer diameter of tube 36. Flange 100 includes a surface 102 that generally faces thread 98. End 92 has an internal machine thread 104 in this embodiment. When assembled to block 32, thread 98 of end 90 is screwed into thread 66 of inner portion 62 of opening 44, and surface 102 of flange 100 seats on or mates with seating surface 68 in opening 44, and in this particular embodiment, flange 100 is substantially between liquid intake opening 42 and gas intake opening 44. In this way, a sealed passage is formed from inner portion 62 of opening 44 and lumen 94 of tube 36. Additionally, the length of tube 36 may be chosen so that when tubes 34 and 36 are assembled to block 32 as described, tube 36 extends within lumen 78 of tube 34 so that end 92 of tube 36 is flush with or inside of end 76 of tube 34. In the illustrated embodiment, flats 96 are substantially similar or identical to flats 80 described above.

Tip 38 includes a first externally threaded end portion 106, a second end portion 108, a body portion 110, a lumen 112, a flange 114 between end 106 and body portion 110, and one or more external flats 116. End 106 includes a machine thread 118 that is compatible with thread 104 of tube 36, and which has a crest diameter somewhat less than an outer diameter of body portion 110. End 108 has an external surface that is substantially conic in the present embodiment, such that the diameter of end 108 is greatest adjacent body portion 110 and decreases with distance from body portion 110. Body portion 110 is relatively short and of a constant outer diameter in this embodiment. Lumen 112 extends through tip 38 from end 106 to end 108, and has a substantially constant diameter through end portion 106 and body portion 110. That diameter of lumen 112 may be substantially the same as the diameter of lumen 94 of tube 36. Lumen 112 tapers within end portion 108, and in a specific embodiment the taper is substantially conical and parallels the slope of the exterior of end portion 108. Flange 114 has an external diameter that is greater than that of body portion 110 and approximately the same as or only slightly smaller than the diameter of lumen 78 of tube 34, and flange 114 forms a surface 120 that generally faces thread 118 and an opposed surface 121. Surfaces 120 and 121 are generally perpendicular to lumen 112 in the illustrated embodiment. Flutes 122 extend through flange 114 at an oblique angle to surface 120, and in a particular embodiment flutes 122 extend from the outer edge of flange 114 to a point adjacent to the exterior surface of body portion 110, and from surface 120 to surface 121. The illustrated embodiment of tip 38 includes six flutes 122 that are angled at from about 5 to 40 degrees with respect to surface 120, and in particular embodiments such an angle may be of about 10 to 25 degrees. It has been found that six flutes 122 provide a particularly effective helical motion for gas that moves through, although it will be seen that other quantities of flutes 122 could be used.

Tip 38 is assembled to inner tube 36 by threading end portion 106 of tip 38 into thread 92 of tube 36. End portion 106 may be sized so that the distance from surface 120 of flange 114 to the end of thread 118 is substantially the same as the length of end portion 92 that is threaded. In that embodiment, assembling tip 38 to tube 36 results in engagement of surface 120 with the outer end of end portion 92, as well as an engagement of the end of end portion 108 with the internal terminus of the threaded portion of end portion 92. Lumen 112 of tip 38 communicates with lumen 94 of tube 36, so that a substantially fluid-tight passage from liquid intake opening 42 of block 32 through tube 36 and tip 38 is formed.

Air cap 40 is substantially cylindrical in the illustrated embodiment, with a first end portion 124, a second end portion 126, and a lumen 128. End portion 124 is internally threaded in this embodiment with a machine thread 130 that is compatible with thread 86 of end 76 of tube 34. End portion 126 includes a head with hexagonal flats 132 in this embodiment. Lumen 128 has a substantially constant diameter through much of cap 40, which diameter may be substantially the same as the diameter of lumen 78 of tube 34. As lumen 128 approaches or enters end portion 126, it tapers substantially conically. Cap 40 screws onto end 76 of tube 34 and around tip 38 and or a portion of tube 36. In the illustrated embodiment, body portion 110 and end portion 108 of tip 38 are within lumen 128 of cap 40, with the end of end portion 108 of tip 38 being substantially flush with the end of end portion 126 of cap 40.

Assembly of nozzle 30 is substantially as noted above. Tubes 34 and 36 both connect to block 32, with tube 36 being inside tube 34. Because the outer diameter of tube 36 is less than the diameter of lumen 78 of tube 34, there is a substantially annular passage 134 created between tube 36 and tube 34. Tip 38 connects to tube 36, and cap 40 connects to tube 34 around tip 38, creating a substantially annular passage 136 between tip 38 and cap 40. Nozzle 30 thus has two passages that are substantially or completely sealed from each other. The first passage, formed by lumens 78, 94 and 112, connects to liquid intake opening 42 of block 32 and allows for passage of a liquid under pressure through to the narrow opening of tip 38. The second passage includes passages 134 and 136, which connects to gas intake opening 44 and allows for passage of a gas (e.g. air) under pressure through flutes 122 and between tip 38 and cap 40 to the narrow opening in cap 40. The connections between the various parts should be substantially fluid-tight. Thus, where machine threads are used between the parts as in the illustrated embodiment, the parts should be subjected to substantial torque in order to make the threaded joints as resistant to leakage as possible.

With nozzle 30 connected to a source of fluid and a source of gas as indicated above, the fluid (e.g. a pharmaceutical preparation) enters block 32 via intake opening 42. Pressure on the fluid forces it into inner region 62 of outlet opening 46, and then into lumen 94 of inner tube 36. Unimpeded by intervening structure, the fluid continues into lumen 112 of tip 38. The narrowing of lumen 112 of tip 38 places the fluid under additional pressure, and the fluid exits tip 38 in a fine stream. At the same time, gas (e.g. air) enters block 32 via intake opening 44, and pressure forces it into outer region 60 of outlet opening 46. The gas proceeds into passage 134 between tubes 34 and 36. When the gas reaches flange 114 of tip 38, it is forced through flutes 122 which give the gas a helical spin around tip 38 and within cap 40. The spinning gas flow exits cap 40 around end 108 of tip 38. In the embodiment in which the ends of tip 30 and cap 40 are substantially flush, the output of the fluid stream and the spinning gas are at substantially the same point. The gas flow interrupts the stream of fluid, creating droplets of fluid of a substantially uniform size range and dispersion pattern. Nozzle 30 is connected or attached to a fluid-bed dryer so that the droplets of fluid can coat particles, as noted above.

The above-described parts of the illustrated embodiment of nozzle 30 may be made of sturdy materials such as metals or hard plastics. Metals may be preferred in some applications because of their machinability, resistance to deterioration from use with heated gases or fluids, generally greater sturdiness and ease of cleaning. Materials may also be chosen for relative resistance to expansion or other change that would alter the passage sizes or compatibility of the various parts. Materials may also be chosen for their compatibility with a particular liquid and/or a particular use. For example, in the embodiment in which a nozzle such as nozzle 30 is used in a pharmaceutical preparation process, certain metals (e.g. stainless steel) or other materials may be used in order to comport with FDA or other standards relating to pharmaceutical manufacture.

A nozzle according the illustrated embodiment has a steady spray with non-variable atomization and dispersal characteristics. The determining factors for the atomization characteristics of the droplets of liquid are the respective pressures placed on the liquid and the gas that pass through the nozzle. Assuming tight connections among the parts of nozzle 30, and therefore little or no loss of pressure as gas and liquid pass through, the inlet pressure of the liquid and gas determine the characteristics of the final spray. Because the parts of the nozzle may be rigid and resistant to expansion, and because there are no parts in the lumen or passage to impede flow or change pressure, any effect of them on liquid or gas pressure will be generally constant. Accordingly, the nozzle itself provides a constant spray given a particular input of liquid and gas at particular pressures.

While the disclosure has been illustrated and described in detail in the drawings and foregoing description, the same is to be considered as illustrative and not restrictive in character, it being understood that only the preferred embodiment has been shown and described and that all changes and modifications that come within the spirit of the disclosure are desired to be protected.

What is claimed is:

1. A nozzle apparatus comprising:

an intake block having a liquid intake opening, a gas intake opening substantially parallel to and offset from said liquid intake opening, and an outlet opening substantially perpendicular to said liquid intake opening, said outlet opening having an outer region extending between an external surface of said block and an internal thread, said outer region being substantially cylindrical and substantially uniform, said outlet opening further having an inner region of a diameter smaller than said outer region that extends between said outer region and an internal thread, said inner region being substantially cylindrical and substantially uniform;

a one-piece inner tube having a lumen, a first externally threaded end, a second internally threaded end, a flange adjacent said first end, said first end being threaded into said inner region of said block so that said inner tube flange contacts a portion of said block to form a substantially fluid-tight seal;

a one-piece outer tube having a lumen, a proximal threaded end and a distal threaded end, said proximal end being threaded into said outer region of said block so that a portion of said tube contacts a portion of said block to form a substantially fluid-tight seal and at least a portion of said outer tube surrounds at least a portion of said inner tube;

a one-piece tip member having a lumen, a threaded end, a narrowing end, and a flange, said tip member lumen having a portion with a substantially constant diameter and a narrowing portion at least partially within said narrowing end, said tip member flange having a plurality of flutes for allowing gas through and changing the motion of said gas, said tip member being threadedly connected to said second end of said inner tube so that said tip member flange contacts a portion of said inner tube to form a substantially fluid-tight seal; and a cap member having a lumen, a rearward end having an opening of said cap member lumen and a forward end having an opening of said cap member lumen that is smaller than said opening of said rearward end, said cap member being threadedly connected to said distal end of said outer tube so that said rearward end contacts a portion of said outer tube to form a substantially fluid-tight seal, wherein said lumens of said inner tube and said tip member form a passage for liquid, said passage having no structure inside it.

2. The apparatus of claim 1, wherein said inner tube and said outer tube form a substantially annular passage for gas.

3. The apparatus of claim 1, wherein said outer tube includes an exterior surface having at least one flat portion for accommodating a turning or gripping tool.

4. The apparatus of claim 1, wherein said inner tube includes an exterior surface having at least one flat portion for accommodating a turning or gripping tool.

5. The apparatus of claim 1, wherein said tip member includes an exterior surface having at least one flat portion for accommodating a turning or gripping tool.

6. The apparatus of claim 1, wherein said threaded ends of said inner tube include standard machine thread.

7. The apparatus of claim 1, wherein said threaded ends of said outer tube include standard machine thread.

8. The apparatus of claim 1, wherein said flange of said one-piece inner tube is substantially between said liquid intake opening and said gas intake opening.

9. The apparatus of claim 1, wherein said block includes a plurality of gas intake openings.

10. A nozzle apparatus consisting essentially of:

an intake block having at least one liquid intake opening, at least one gas intake opening, and an outlet opening;

an inner tube having a lumen, a first end, a second end and a flange, said first end being connected to said block in said outlet opening so that said inner tube lumen communicates with said liquid intake opening;

an outer tube having a lumen, a proximal end and a distal end, said proximal end being connected to said block in said outlet opening and around at least a portion of said inner tube, so that said outer tube lumen communicates with said gas intake opening and so that a substantially annular passage exists between said inner tube and said outer tube;

a tip member having a lumen, a connecting end, an outlet end, and a flange, said tip member being connected to said second end of said inner tube so that said tip member lumen communicates with said inner tube lumen, wherein said flange of said tip member forms a substantially fluid-tight seal with said inner tube; and a cap member having a lumen, a rearward end, and a forward end having an opening of said cap member lumen, said cap member being connected to said distal end of said outer tube and over said tip member so that said outlet end is adjacent said opening of said forward end of said cap member, wherein said lumens of said inner tube and said tip member form a passage for liquid, and said substantially annular passage forms a passage for gas.

11. The apparatus of claim 10, wherein at least one of said inner tube, outer tube and tip member has at least one flat portion for accommodating a turning or gripping tool.

12. The apparatus of claim 10, wherein said flange of said inner tube forms a substantially fluid-tight seal with said block.

13. The apparatus of claim 10, wherein said outer tube engages said block to form a substantially fluid-tight seal with said block.

14. The apparatus of claim 10, wherein said connecting end of said tip member has an end surface and said second end of said inner tube is internally threaded and has a seat surface, and said end surface of said tip member and said seat surface of said inner tube abut each other.

15. The apparatus of claim 10, further consisting essentially of a connection portion integral with said block, said connection portion being externally threaded and having a boss.

16. The apparatus of claim 10, wherein said flange of said inner tube is substantially between said liquid intake opening and said gas intake opening.

17. The apparatus of claim 10, wherein said block includes a plurality of gas intake openings.

* * * * *